US011608215B1

(12) United States Patent
Giordano

(10) Patent No.: US 11,608,215 B1
(45) Date of Patent: Mar. 21, 2023

(54) WATER BOTTLE WITH PUSH-TWIST END CAP ASSEMBLY

(71) Applicant: Erica Giordano, Gaithersburg, MD (US)

(72) Inventor: Erica Giordano, Gaithersburg, MD (US)

( * ) Notice: Subject to any disclaimer, the term of this patent is extended or adjusted under 35 U.S.C. 154(b) by 31 days.

(21) Appl. No.: 17/141,287

(22) Filed: Jan. 5, 2021

Related U.S. Application Data

(60) Provisional application No. 62/959,959, filed on Jan. 11, 2020.

(51) Int. Cl.

| | |
|---|---|
| ***B65D 1/04*** | (2006.01) |
| ***B65D 41/04*** | (2006.01) |
| ***A45F 3/18*** | (2006.01) |
| ***B65D 1/02*** | (2006.01) |

(52) U.S. Cl.
CPC ..... *B65D 41/0492* (2013.01); *A45F 3/18* (2013.01); *B65D 1/0246* (2013.01); *B65D 1/0261* (2013.01); *B65D 41/0442* (2013.01)

(58) Field of Classification Search
CPC ..... B65D 41/0478; B65D 41/0492; B65D 41/0457; B65D 41/0414; B65D 1/0246; B65D 1/0261; B65D 41/0442; A45F 3/18
See application file for complete search history.

(56) References Cited

U.S. PATENT DOCUMENTS

| | | | | |
|---|---|---|---|---|
| 4,410,098 | A | 10/1983 | Dubs et al. | |
| 5,435,112 | A * | 7/1995 | Goyet | B65B 3/16 53/367 |
| 5,699,922 | A * | 12/1997 | Harding | F01P 11/0214 215/208 |
| 6,142,325 | A | 11/2000 | Chomik | |
| 8,365,941 | B2 | 2/2013 | Mayer | |
| 9,656,191 | B2 | 5/2017 | Hull et al. | |
| 10,077,141 | B2 * | 9/2018 | Brandriff | B65D 41/0414 |
| 2012/0018343 | A1 | 1/2012 | Carland | |
| 2012/0085725 | A1 | 4/2012 | Parekh et al. | |
| 2015/0225133 | A1 * | 8/2015 | Emircan | B65D 41/0478 220/254.8 |
| 2016/0176590 | A1 * | 6/2016 | Prater | B65D 85/70 215/44 |
| 2017/0202748 | A1 * | 7/2017 | Gosselin | B65D 41/0478 |

(Continued)

FOREIGN PATENT DOCUMENTS

| | | | |
|---|---|---|---|
| CN | 108100398 | A | 6/2018 |
| FR | 3034634 | A1 | 10/2016 |

OTHER PUBLICATIONS

English Abstract for CN108100398 A, printed on Nov. 11, 2020.

(Continued)

*Primary Examiner* — Ernesto A Grano
*Assistant Examiner* — Symren K Sanghera
(74) *Attorney, Agent, or Firm* — Cahn & Samuels, LLP

(57) ABSTRACT

A water bottle includes a body having a threaded portion on a first end and an end cap assembly. The end cap assembly includes an inner lid having 1) a threaded portion to engage the threaded portion on the first end of the body and 2) a circular flange or rim having a structure extending downwardly, thereby forming a plurality of grooves or notches; and an outer lid having a structure on a circumferential top surface forming a plurality of projections.

17 Claims, 10 Drawing Sheets

(56) References Cited

U.S. PATENT DOCUMENTS

| | | | | |
|---|---|---|---|---|
| 2018/0162582 | A1 | 6/2018 | Deylamian et al. | |
| 2019/0084727 | A1* | 3/2019 | Brandriff | B65D 41/0442 |
| 2019/0351351 | A1* | 11/2019 | Singh | B65D 47/32 |
| 2020/0047948 | A1* | 2/2020 | Zitron | B65D 25/42 |
| 2020/0324944 | A1* | 10/2020 | Kim | A45D 34/00 |
| 2021/0130052 | A1* | 5/2021 | Berge | B65D 51/18 |

OTHER PUBLICATIONS

English Abstract for FR3034634 A1, printed on Nov. 11, 2020.
Girodano, "A stainless steel water bottle that opens from both ends", Kickstarter, https://www.kickstarter.com/projects/toob/a-stainless-steel-water-bottle-that-opens-from-both-ends, printed on Sep. 22, 2020.
"The Original Clean Bottle", https://www.cleanbottle.com/products/the-original-clean-bottle-2, printed on Sep. 22, 2020.
Amazon, "Zulu Ace 24ox Stainless Steel Water Bottle with Removable base", https://www.amazon.com/ZULU-Stainless-Steel-Bottle-Removable/dp/B07PN6YDLZ, printed on Sep. 22, 2020.
"SimplyKlean Insulated Stainless Steel Easy to Clean and Load Ice Water Bottle/Coffee or Tea Thermos, Opens Top and Bottom, 17 oz," https://www.amazon.com/Hygienic-High-Grade-Stainless-Insulated-BPA-Free/dp/B07H8531Y6, , printed on Sep. 22, 2020.
S'Wheat The Bottle That's Made from Plants, https://www.crowdfunder.co.uk/s-wheat-the-bottle-that-s-made-from-plants, printed on Sep. 22, 2020.
Cafago "Outdoor Water Bottle", https://www.cafago.com/en/p-y14185b.html, printed on Sep. 22, 2020.

* cited by examiner

WATER BOTTLE WITH PUSH-TWIST END CAP ASSEMBLY

This nonprovisional patent application claims priority to U.S. Ser. No. 62/959,959 filed in the U.S. Patent and Trademark Office on 11 Jan. 2020, the entirety of which is incorporated herein by reference.

FIELD OF INVENTION

The present invention is directed to a water bottle. In particular, the invention is directed to a water bottle that can be opened on both ends and has a push-twist end cap assembly.

BACKGROUND AND SUMMARY OF INVENTION

Reusable water bottles are a popular alternative to disposable bottles. Conventional reusable water bottles or liquid bottles have only one open end, where a cap or lid is typically removably secured. Such bottle designs may be difficult and time-consuming to clean thoroughly.

An advantage of the water bottle of the present invention is that it opens at both ends. Thus, a user can reach all parts of the bottle and ensure complete and easy cleaning.

A further advantage of the water bottle of the present invention is that total cleaning of the bottle helps eliminate biofilm and other disease-causing bacteria from building up in places that may be difficult to reach in a typical water bottle.

A still further advantage of the water bottle of the present invention is that it has a push-twist end cap assembly on at least one end (e.g., the bottom end) of the water bottle.

According to an embodiment of the present invention, a water bottle comprises a body having a threaded portion on a first end. An end cap assembly includes an inner lid having a threaded portion to engage the threaded portion on the first end of the body and a circular flange or rim having a structure extending downwardly, thereby forming a plurality of grooves or notches, and an outer lid having a structure on a circumferential top surface forming a plurality of projections.

According to another embodiment of the present invention, a bottle comprises a body having a top end and a bottom end. A bottom end cap assembly includes an inner lid having a circular flange or rim having a structure extending downwardly from an outer circumferential edge, thereby forming a plurality of grooves or notches; and an outer lid having a structure on a circumferential top surface forming a plurality of projections. When the outer lid is pushed onto the inner lid, the plurality of projections are configured to form a tongue-and-groove connection with the plurality of grooves or notches.

According to another embodiment of the present invention, a bottle comprises a body having a first end and a second end. An end cap assembly includes an inner lid having a recessed portion on a bottom surface, the recessed portion having a circular flange or lip extending inwardly from and along an inner circumferential surface or edge; and an outer lid having a circular protrusion extending upwardly from a bottom surface and having a circular flange or lip extending outwardly from and along an outer circumferential surface or edge of the circular protrusion. The inner lid and the outer lid are in sliding and/or rotational engagement.

DETAILED DESCRIPTION OF THE INVENTION

The present invention is directed to a water bottle. In particular, the invention is directed to a water bottle that can be opened on both ends and has a push-twist end cap assembly as discussed below. A specific embodiment of the water bottle is commercially known as TOOB™. Although the detailed description refers to a water bottle, the bottle could be used to hold other materials or liquids.

In the detailed description, references to "one embodiment", "an embodiment", or "in embodiments" mean that the feature being referred to is included in at least one embodiment of the invention. Moreover, separate references to "one embodiment", "an embodiment", or "embodiments" do not necessarily refer to the same embodiment; however, neither are such embodiments mutually exclusive, unless so stated, and except as will be readily apparent to those skilled in the art. Thus, the invention can include any variety of combinations and/or integrations of the embodiments described herein.

As used herein "substantially", "generally", and other words of degree are relative modifiers intended to indicate permissible variation from the characteristic so modified (e.g., ±0.1%, ±0.5%, ±1.0%, ±2%, ±5%, ±10%, ±20%). It is not intended to be limited to the absolute value or characteristic which it modifies but rather possessing more of the physical or functional characteristic than its opposite, and preferably, approaching or approximating such a physical or functional characteristic.

Figure 1:
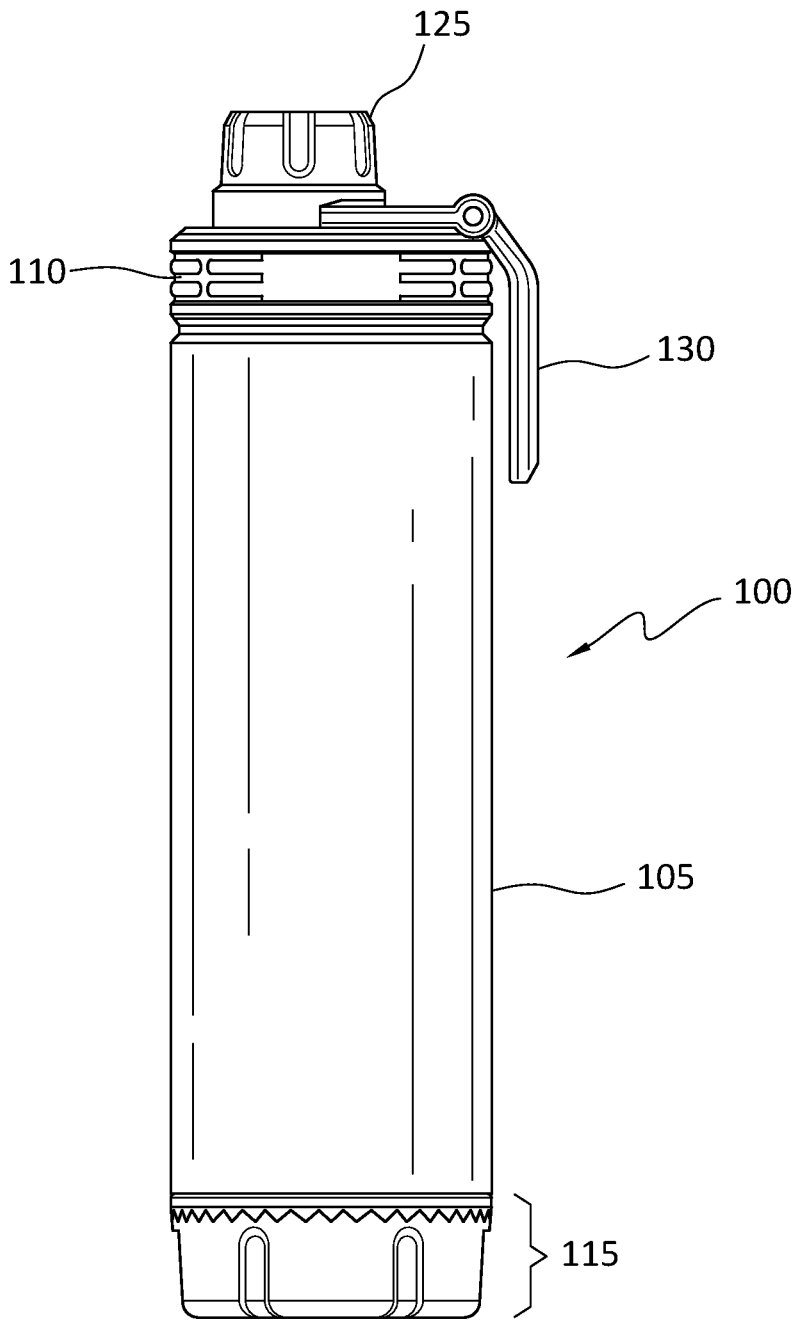
FIG. 1 illustrates a side view of a water bottle according to an embodiment of the present invention.
Figure 2:
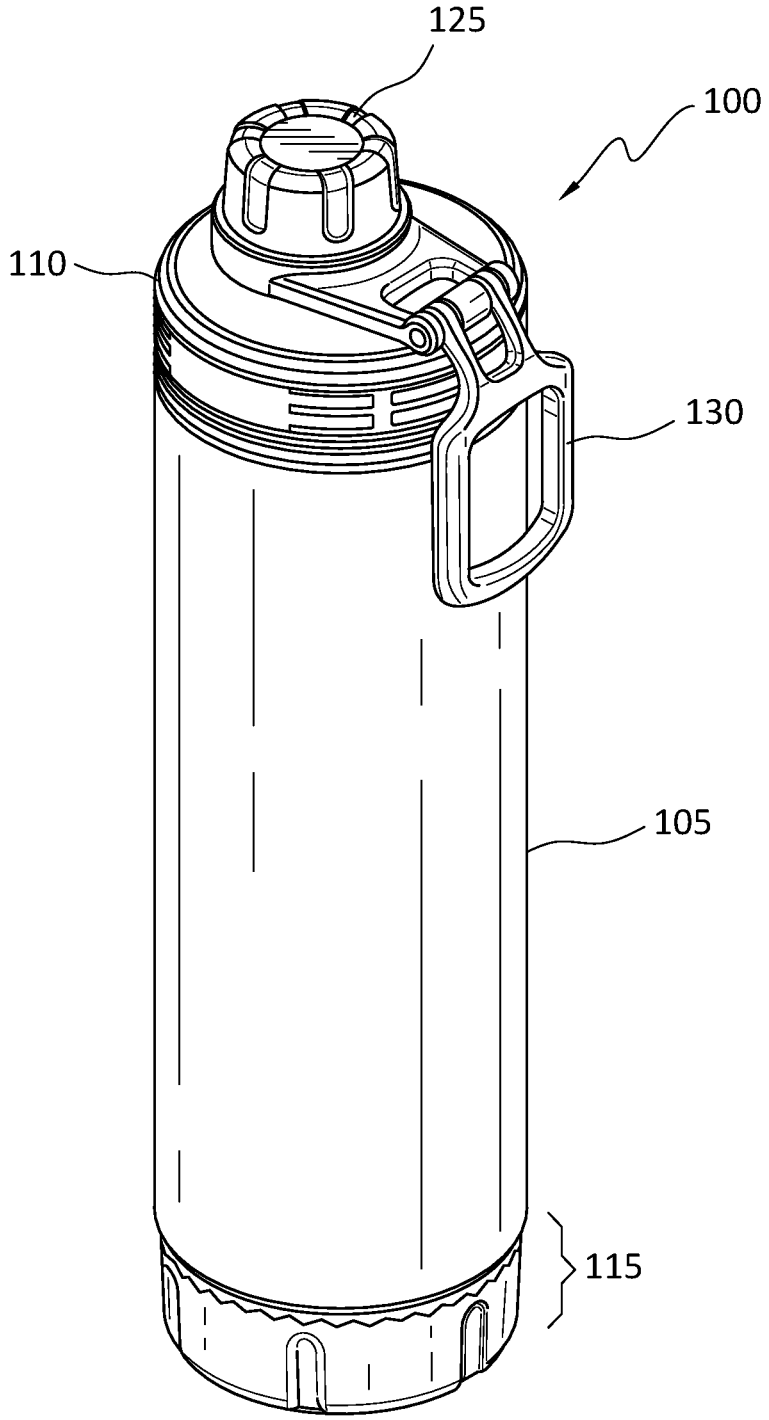
FIG. 2 illustrates a perspective side view of the water bottle of FIG. 1.
Figure 7:
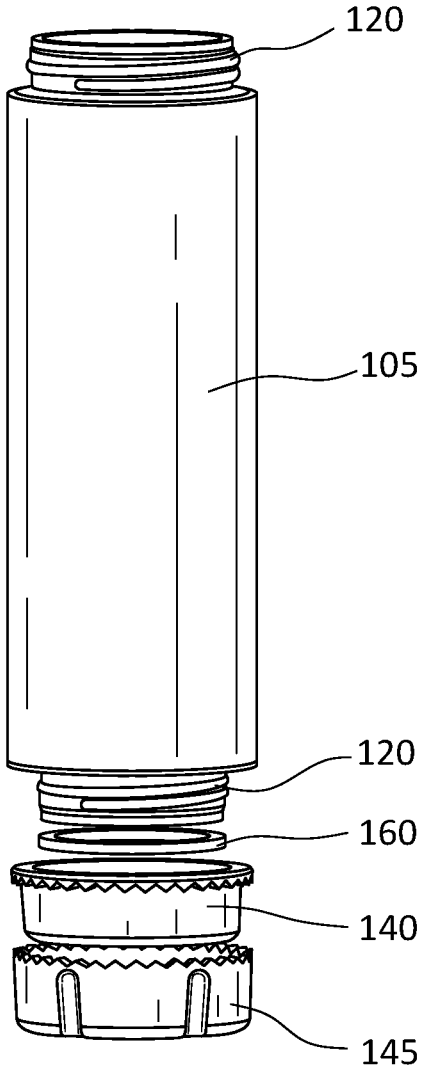
FIG. 7 illustrates a side view of a water bottle including threaded portion on a top end and a push-twist end cap assembly according to an embodiment of the present invention.
Figure 8:
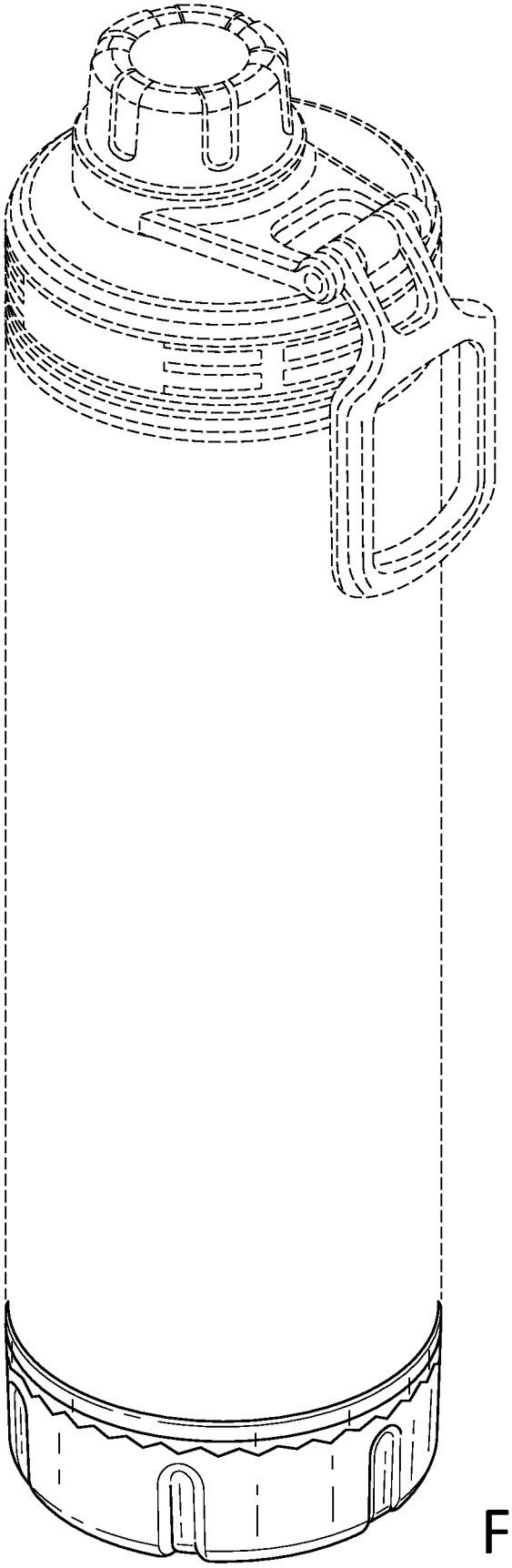
FIG. 8 illustrates a perspective view of a water bottle according to an embodiment of the present invention.
Figure 9:
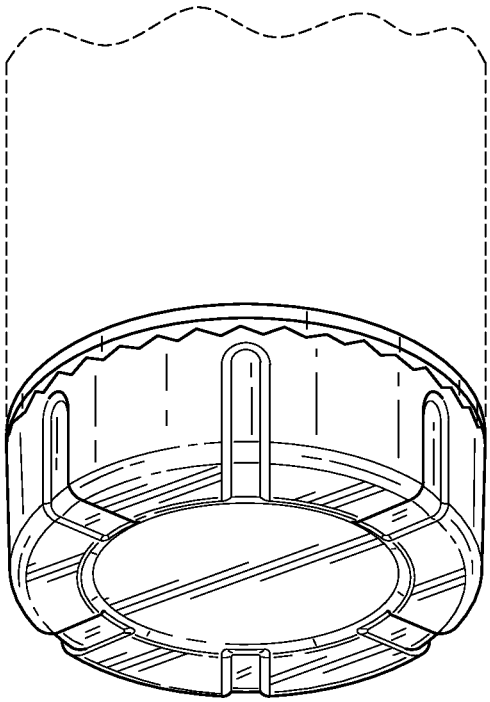
FIG. 9 illustrates a perspective view a push-twist end cap assembly for the water bottle of FIG. 8.
Figure 10:
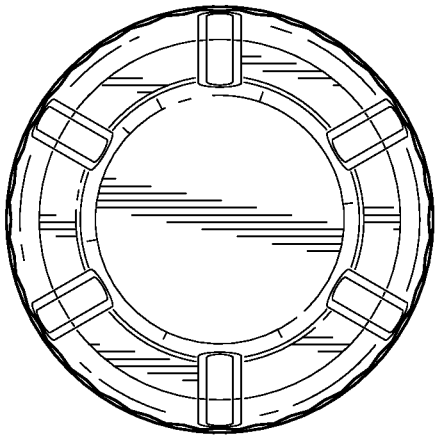
FIG. 10 illustrates a bottom view for the water bottle of FIG. 8.
Figure 11:
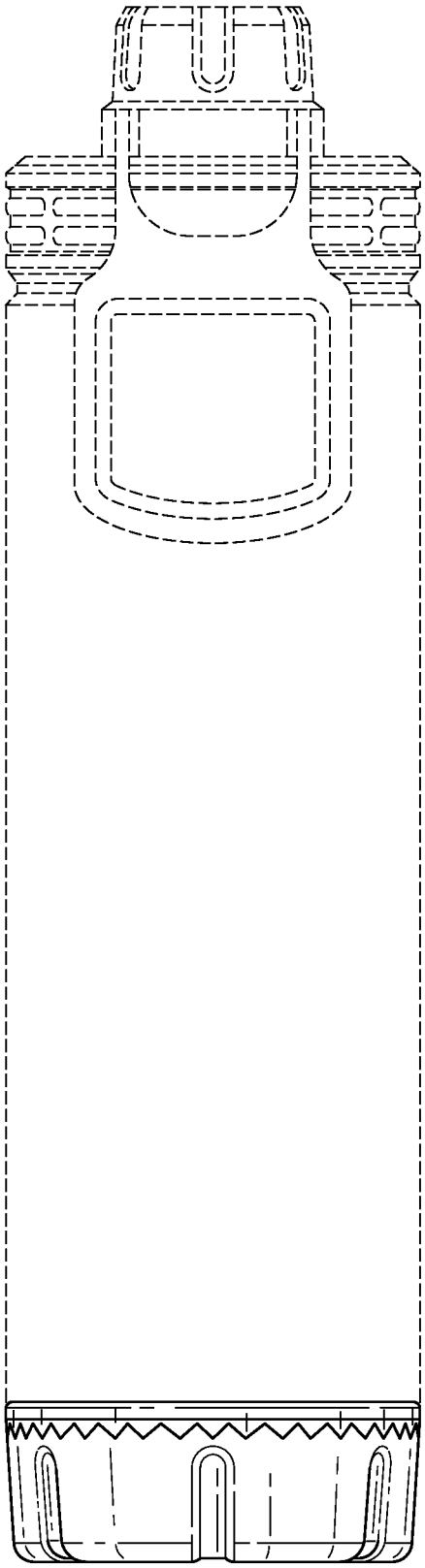
FIG. 11 illustrates a front view for the water bottle of FIG. 8.
Figure 12:
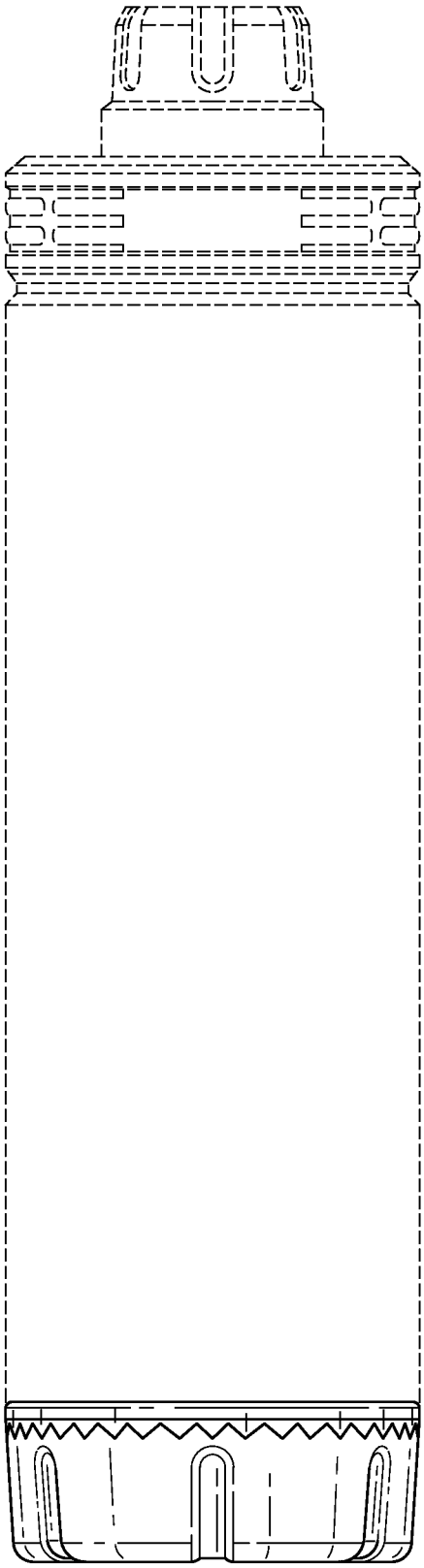
FIG. 12 illustrates a rear view for the water bottle of FIG. 8.
Figure 13:
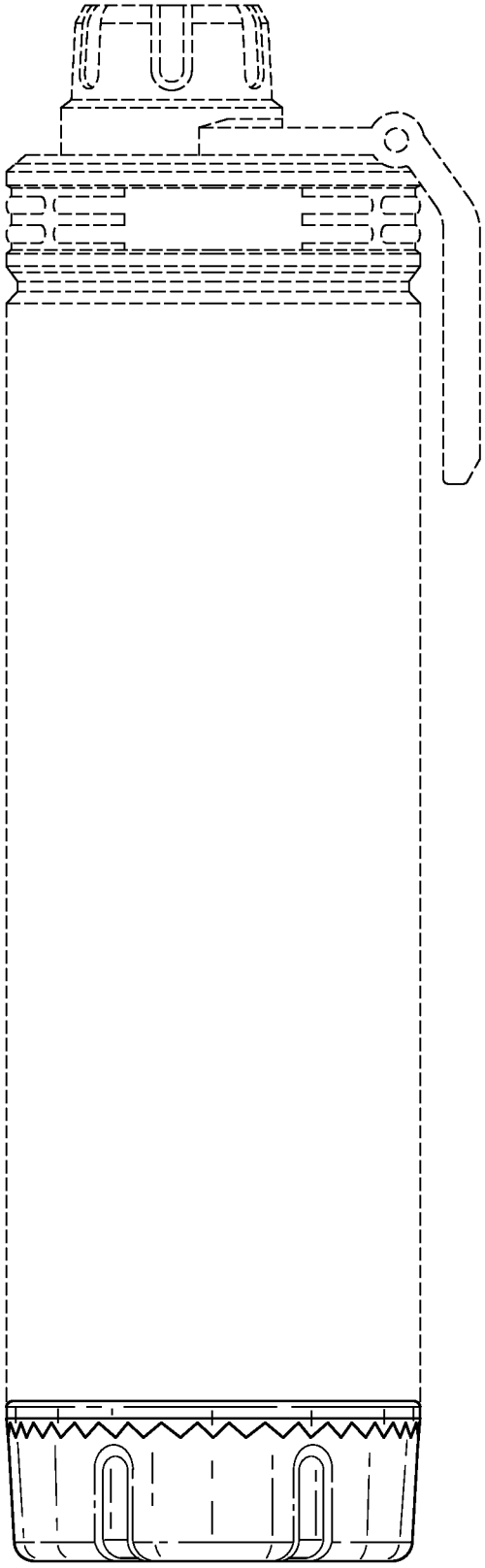
FIG. 13 illustrates a right side view for the water bottle of FIG. 8.
Figure 14:
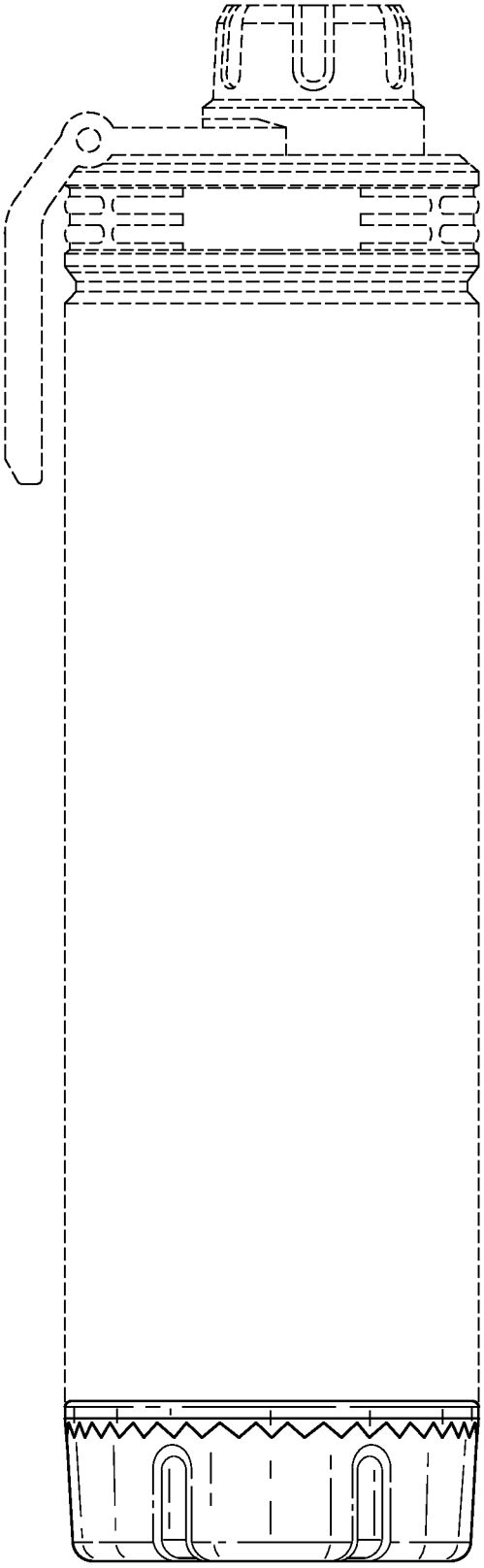
FIG. 14 illustrates a left side view for the water bottle of FIG. 8.

According to the present invention, as illustrated in FIGS. 1-2, a water bottle 100 includes a main body 105, a top end cap 110, and a bottom end cap assembly 115. In one embodiment, main body 105 has a substantially cylindrical shape. In a specific embodiment, the main body may have a double wall vacuum or air gap to provide insulation. Bottle 100 may be made of any suitable material including, but not limited to, metal, metal alloy(s), plastic, glass, or any combination thereof. In a specific embodiment, main body 105 comprises stainless steel, and each of top end cap 110 and bottom end cap assembly 115 comprises polypropylene, high-density or low-density polyethylene, polycarbonate, or any combination thereof. Main body 105 may have threaded portions or screw threads 120 about the top end (FIG. 7), the bottom end (FIGS. 3-7), or both ends to facilitate engagement of top end cap 110 and/or bottom end cap assembly 115.

In a specific embodiment, top end cap 110 has threads that allow it to be removably screwed or twisted on a matching threaded portion 120 on the top of main body 105. In an embodiment, top end cap 110 includes a spout 125 for drinking purposes. In a specific embodiment, top end cap 110 may include a clip or other fastener 130 to allow attachment of the water bottle to another object, for example, clothing, outdoor or camping equipment, cup holders, and the like. In a specific embodiment, top end cap 110 may include an O-ring made of rubber, silicone, or any suitable material, disposed between top end cap 110 and main body 105, thereby ensuring a water-tight seal once top end cap 110 is screwed onto main body 105.

FIGS. 3-7 illustrate embodiments of a push-twist end cap assembly. Although the push-twist end cap assembly is described as bottom end cap assembly 115, the top end cap may have a similar functionality.

Bottom end cap assembly 115 includes an inner lid or cap 140 and outer lid or cap 145. Inner lid 140 has an internal thread member 150 for removably screwing inner lid 140 onto corresponding threaded portion 120 on the bottom end of main body 105. In specific embodiments, inner lid 140 may have a recessed portion 155 on or near a bottom surface for holding an O-ring 160 made of rubber, silicone, or any suitable material, thereby ensuring a water-tight seal once bottom end cap assembly 115 is screwed onto main body 105.

Figure 3:
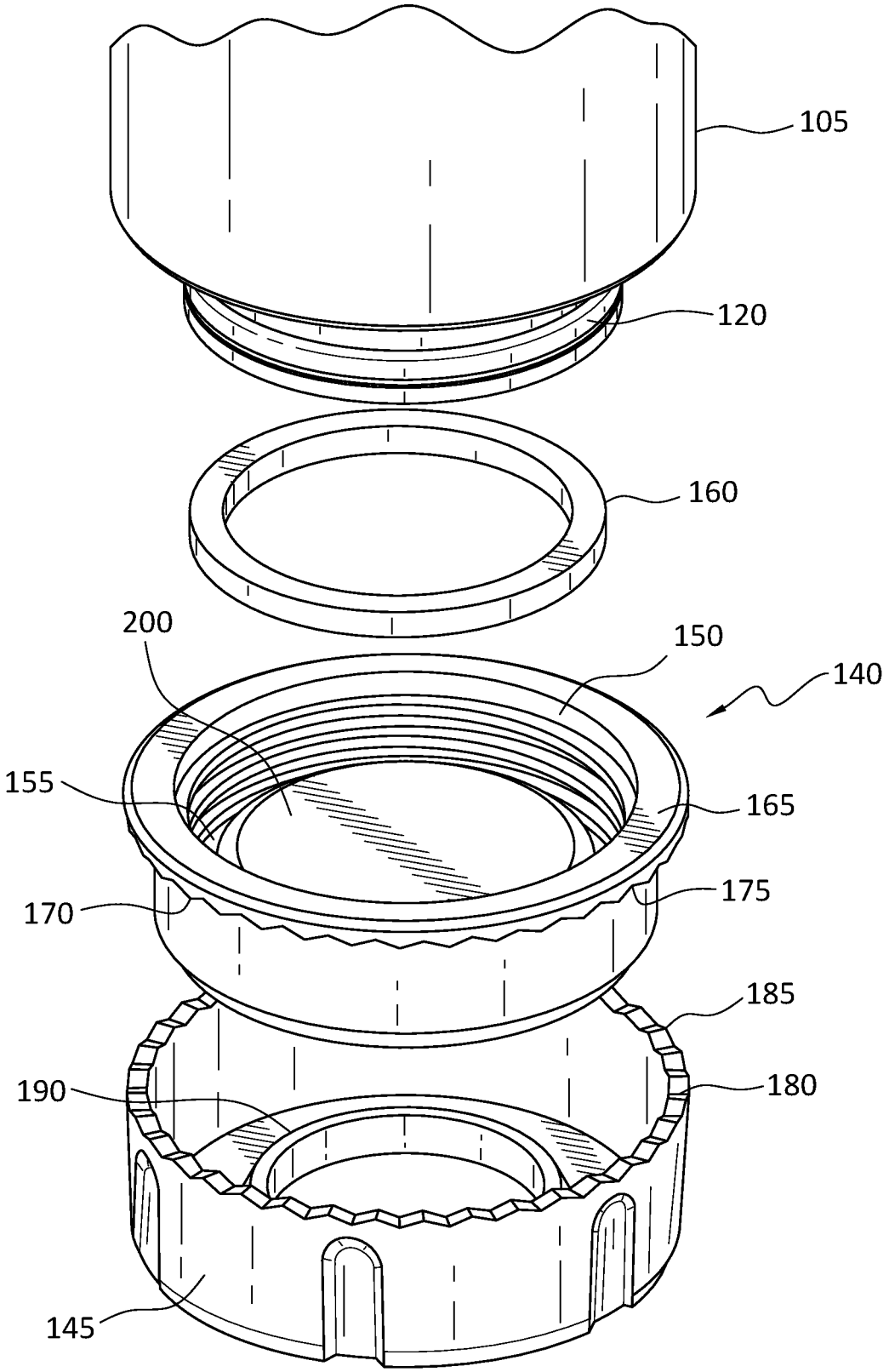
FIG. 3 illustrates an exploded perspective view of a push-twist end cap assembly for a water bottle according to an embodiment of the present invention.
Figure 4:
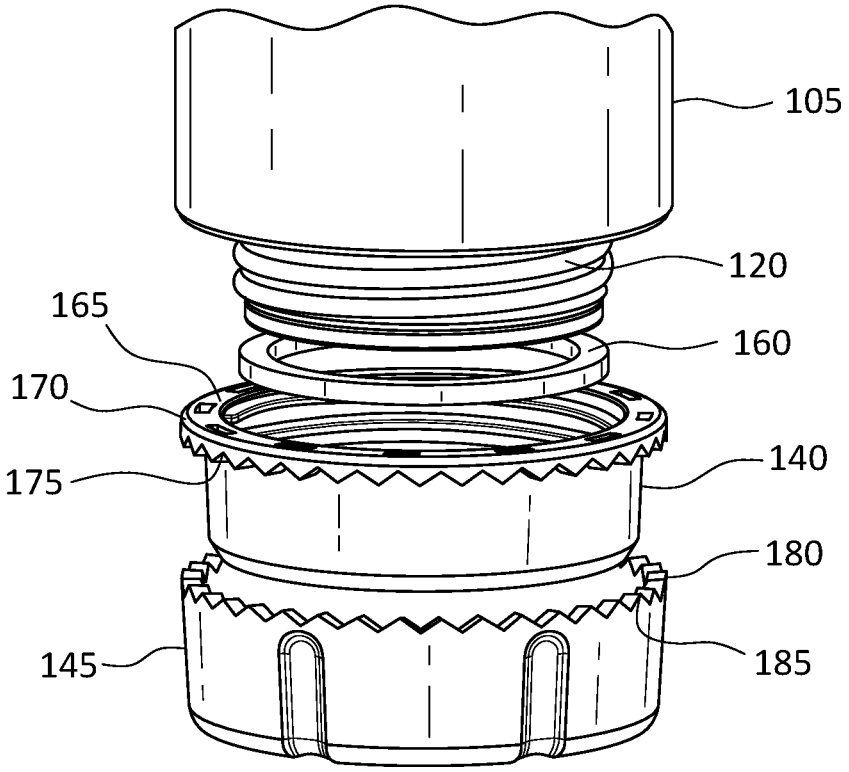
FIG. 4 illustrates an exploded side view of a push-twist end cap assembly for a water bottle.

In a specific embodiment, a top of inner lid 140 has a circular flange or rim 165 extending around a circumference of the inner lid. As shown in FIGS. 3-4, the circular flange or rim 165 has a structure 170 extending downwardly from the flange or rim, thereby forming a plurality of grooves or notches 175. In a specific embodiment, the structure 170 may be ridged or have a zig-zag configuration such that the grooves or notches have angled sides.

In a specific embodiment, outer lid 145 has a larger diameter than the diameter of the inner lid 140. The circumferential top surface of the outer lid 145 has a structure 180, forming a plurality of projections 185. In a specific embodiment, the structure 180 may be ridged or have a zig-zag configuration such that each projection has angled sides (e.g., an angle corresponding to the angle of grooves or notches 175).

The plurality of projections 185 are configured to engage the corresponding plurality of grooves or notches 175 on the inner lid 140 in the form of a tongue-and-groove connection when bottom end cap assembly 115 is attached to or connects with main body 105. Thus, a user may push the outer lid 145 onto the inner lid 140, such that the tongue-and-groove connection is formed. The tongue-and-groove connection allows for easy twisting or turning of bottom end cap assembly 115 (a "push-twist" or "push-turn" functionality) to secure and/or remove it from main body 105.

Figure 5:
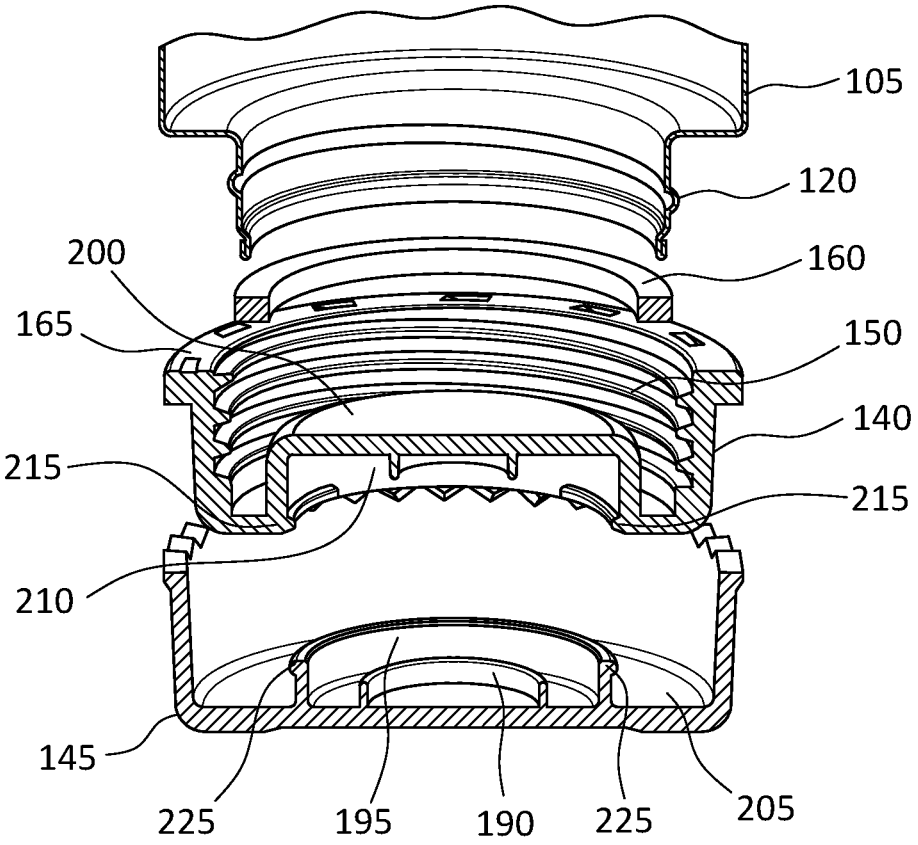
FIG. 5 illustrates a cutaway exploded view of the push-twist end cap assembly of FIG. 4.
Figure 6:
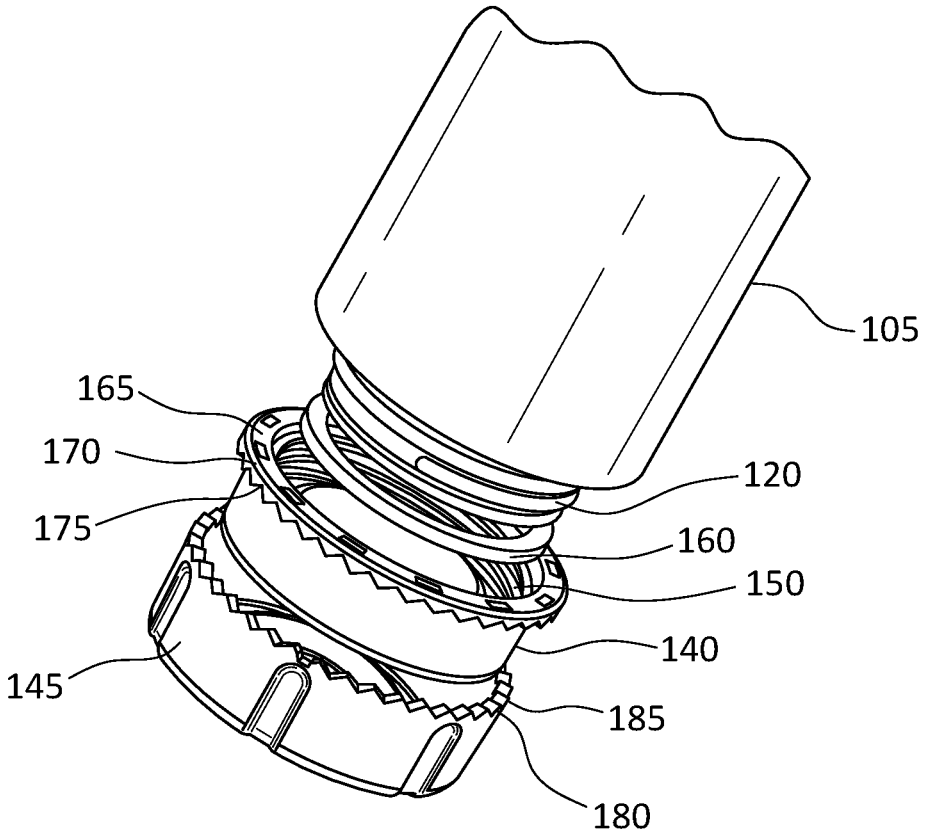
FIG. 6 illustrates exploded side view of portion of a tilted water bottle including the push-twist end cap assembly of FIGS. 4-5.

As shown in FIG. 5, in some embodiments, the bottom surface of inner lid 140 has a recessed portion 200. The recessed portion 200 may have a circular protrusion 210 that is centrally-disposed and extends downwardly from the bottom surface of recessed portion 200. The circular protrusion 210 is configured to fit within a corresponding circular protrusion 190 extending upwardly from a bottom surface 205 of outer lid 145.

The recessed portion 200 may have a circular flange or lip 215 extending inwardly from and along an inner circumferential surface or edge. The inwardly-facing circular flange or lip 215 is configured to engage a corresponding circular flange or lip 225, which extends outwardly from and along an outer circumferential surface or edge of circular protrusion 195, which extends upwardly from a bottom surface of outer lid 145. This configuration provides for a degree of sliding and/or for rotational movement between inner lid 140 and outer lid 145 and helps facilitate the tongue-and-groove and push-twist features discussed above. This configuration also helps preventing undesired disengagement of inner lid 140 from outer lid 145.

FIGS. 8-14 illustrate a water bottle according to an embodiment of the present invention.

Although only certain embodiments of the invention have been illustrated in the foregoing specification, it is understood by those skilled in the art that many modifications and embodiments of the invention will come to mind to which the invention pertains, having benefit of the teaching presented in the foregoing description and associated drawings.

It is therefore understood that the invention is not limited to the specific embodiments disclosed herein, and that many modifications and other embodiments of the invention are intended to be included within the scope of the invention. Moreover, although specific terms are employed herein, they are used only in a generic and descriptive sense, and not for the purposes of limiting the description of the invention.

What is claimed is:

1. A water bottle, comprising:
a body having a threaded portion on a first end;
an end cap assembly comprising:
an inner lid having 1) a threaded portion to engage the threaded portion on the first end of the body and 2) a circular flange or rim having a structure extending downwardly, thereby forming a plurality of grooves or notches, wherein a bottom surface of the inner lid has a recessed portion having a circular flange or lip extending inwardly from and along an inner circumferential surface or edge thereof; and
an outer lid having (1) a structure on a circumferential top surface forming a plurality of projections, and (2) a circular protrusion that extends upwardly from a bottom surface of the outer lid having a corresponding circular flange or lip that extends outwardly from and along an outer circumferential surface or edge thereof,
wherein the inwardly-facing circular flange or lip of the inner lid is configured to engage the corresponding circular flange or lip of the outer lid in sliding and/or rotation movement.

2. The water bottle of claim 1, wherein, when the outer lid is pushed onto the inner lid, the plurality of projections is configured to form a tongue-and-groove connection with the plurality of grooves or notches.

3. The water bottle of claim 1, wherein the plurality of grooves or notches have angled sides.

4. The water bottle of claim 1, wherein the plurality of projections has angled sides.

5. The water bottle of claim 1, further comprising a top end cap having a threaded portion configured to engage the threaded portion on the first end of the body.

6. The water bottle of claim 1, wherein the end cap assembly further comprises an O-ring.

7. The water bottle of claim 6, wherein the O-ring comprises rubber or silicone.

8. The water bottle of claim 1, wherein the end cap assembly comprises polypropylene or polyethylene.

9. The water bottle of claim 1, wherein the outer lid has a diameter larger than that of the inner lid.

10. The water bottle of claim 1, wherein the recessed portion has a centrally-disposed circular protrusion extending downwardly from a bottom surface of the recessed portion.

11. The water bottle of claim 10, wherein the bottom surface of the outer lid has a circular protrusion extending upwardly, and wherein the centrally-disposed, downwardly extending circular protrusion of the inner lid is configured to fit within the upwardly-extending circular protrusion of the outer lid.

12. A bottle, comprising:

a body having a top end and a bottom end;

a bottom end cap assembly comprising:

an inner lid having a circular flange or rim having a structure extending downwardly from an outer circumferential edge forming a plurality of grooves or notches, and a bottom surface of the inner lid having a recessed portion with a circular flange or lip extending inwardly from and along an inner circumferential surface or edge thereof; and an outer lid having a structure on a circumferential top surface forming a plurality of projections, and a circular protrusion that extends upwardly from a bottom surface of the outer lid having a corresponding circular flange or lip that extends outwardly from and along an outer circumferential surface or edge thereof, wherein, when the outer lid is pushed onto the inner lid, the plurality of projections are configured to form a tongue-and-groove connection with the plurality of grooves or notches, and wherein the inwardly-facing circular flange or lip of the inner lid is configured to engage the corresponding circular flange or lip of the outer lid in sliding and/or rotation movement.

13. The bottle according to claim 12, wherein the top end and the bottom end are both openable.

14. A bottle, comprising:

a body having a first end and a second end;

an end cap assembly comprising:

an inner lid having a recessed portion on a bottom surface, the recessed portion having a circular flange or lip extending inwardly from and along an inner circumferential surface "or edge" wherein the inner lid further comprises a circular flange or rim having a structure extending downwardly, thereby forming a plurality of grooves or notches; and an outer lid having a circular protrusion extending upwardly from a bottom surface and having a circular flange or lip extending outwardly from and along an outer circumferential surface or edge of the circular "protrusion;" wherein the outer lid further comprises a structure on a circumferential top surface forming a plurality of projections, wherein the inner lid and the outer lid are in sliding and rotational engagement.

15. The bottle according to claim 14, wherein the first end and the second end are both openable.

16. The water bottle of claim 1, wherein the body further comprises a second end.

17. The water bottle of claim 1, wherein the inner lid and the outer lid are in sliding and rotational engagement.

* * * * *